US006493947B2

(12) United States Patent
Stokes

(10) Patent No.: US 6,493,947 B2
(45) Date of Patent: Dec. 17, 2002

(54) SCISSORS

(75) Inventor: Andrew John Stokes, Sheffield (GB)

(73) Assignee: McPherson's Limited, Victoria (AU)

( * ) Notice: Subject to any disclaimer, the term of this patent is extended or adjusted under 35 U.S.C. 154(b) by 0 days.

(21) Appl. No.: 09/767,181

(22) Filed: Jan. 22, 2001

(65) Prior Publication Data

US 2001/0022028 A1 Sep. 20, 2001

(30) Foreign Application Priority Data

Feb. 3, 2000 (GB) ..... 0002438

(51) Int. Cl.[7] ..... B26B 13/20
(52) U.S. Cl. ..... 30/341; 30/232; D8/57
(58) Field of Search ..... 30/232, 254, 340, 30/341; D8/57

(56) References Cited

U.S. PATENT DOCUMENTS

| | | | | | |
|---|---|---|---|---|---|
| 606,472 | A | * | 6/1898 | Ogden | 30/341 |
| 923,734 | A | * | 6/1909 | Tindall | 30/341 |
| 1,089,183 | A | * | 3/1914 | Beer | 30/341 |
| 1,317,041 | A | * | 9/1919 | Scott | 30/341 |
| 4,407,069 | A | | 10/1983 | Conners | 20/254 |
| D277,450 | S | * | 2/1985 | Hayashi | D8/57 |
| D383,957 | S | * | 9/1997 | Cornell | D8/57 |
| 5,819,416 | A | * | 10/1998 | Robinson et al. | 30/341 |
| 6,000,138 | A | * | 12/1999 | Bornancini | 30/232 |

FOREIGN PATENT DOCUMENTS

| | | |
|---|---|---|
| NZ | 244626 | 4/1994 |

* cited by examiner

*Primary Examiner*—Hwei-Siu C. Payer
(74) *Attorney, Agent, or Firm*—Trexler, Bushnell, Giangiorg, Blackstone & Marr, Ltd.

(57) ABSTRACT

The invention relates to scissors. Hitherto scissors have been formed with rigid and identical handles to allow use in either hand, but with some discomfort to the user, or with handles specifically shaped to suit a right-handed or a left-handed user, but not both. The object of the invention is to provide a pair of scissors able to be used in comfort by both right-handed and left-handed users, an objective met by a construction comprising blades and associated handles pivotally secured together, the handles forming respective finger and thumb bows that are symmetrical about the center plane at the mid-point through their thickness, at least one (thumb) bow being formed as a rigid structure from the forward end towards the pivot to a point along the length of that bow, from where the at least one (thumb) bow has a rearward part formed from a form-stable but resilient and/or flexible material.

11 Claims, 7 Drawing Sheets

SCISSORS

This invention relates to scissors.

It has long been known to manufacture scissors with finger and thumb bows either of the same size or with the finger bow larger than the thumb bow, and with both bows symmetrical about a central plane mid-point-of the handle thickness. So formed, the scissors can be used in both the left and right hand, but with the scissors not ideally suited for use in either hand.

To make scissors more comfortable to use, it has long been known to shape the finger and/or thumb bows to better suit their engagement by the hand of the user. However, and hitherto, shaping scissor bows has only been done to suit either the right hand or the left hand, and not both, and as there are greater numbers of right handed prospective users of scissors, it has been so that right handed scissors have been dominant, to the disadvantage of left-handed users.

The object of the invention is to provide a pair of scissors able to be used in comfort by both right handed and left handed users.

According to the present invention, a pair of scissors comprises blades and associated handles pivotally secured together, the handles forming respective finger and thumb bows that are symmetrical about the centre plane at the mid-point through their thickness, at least one (thumb) bow being formed as a rigid structure from the forward end towards the pivot to a point along the length of that bow, from where the at least one (thumb) bow has a rearward part formed from a form-stable but resilient and/or flexible material.

Preferably the aperture through the at least one (thumb) bow is formed wholly within the part of that bow formed from resilient and/or flexible material.

The other (finger) bow of the pair of scissors may be formed from hard material in conventional manner but preferably is also formed partly from hard material and partly from form-stable but resilient and/or flexible material, and again, it is desirable for the aperture in the other (finger) bow to be formed wholly within the part of that bow formed from resilient and/or flexible material.

For smaller scissors, it is conventionally so that the two bows are identically formed and this may be so with scissors of the invention. Thus, the handles may be identically formed as forward sections of hard material, and rearward sections containing the bows for the finger and the thumb respectively of either the left or the right hand. When the scissors are closed with reasonable force to cut the material placed between the blades, pressure from the thumb at least, is applied to the resilient and/or flexible section of the respective bow, to cause the rearward portion of the bow to flex, to the considerable comfort to the user, whether they be right or left handed.

With regard to both larger and smaller scissors, the hard material of the parts of the handles towards the pivots is preferably polypropylene, and the resilient flexible material of the rearward section is preferably santropene.

For larger scissors, it is customary for the finger bow to be larger than the thumb bow and allow several fingers to engage in the aperture. Here again whether used in the left or the right hand, a cutting force applied to the bows causes at least the thumb bow to yield or flex, to the considerable comfort to users whether they be right or left handed. With large scissors, the hard material of the forward part of the finger bow may be extended further along that bow over its upper and/or lower edge to provide a greater stability in the finger bow to resist the force applied by the fingers during the cutting action.

Two embodiments of the invention will now be described by way of example only with reference to the accompanying drawings, in which:

FIG. 1 is an elevation from one side of a large pair of scissors in the open condition;

FIG. 2 corresponds to FIG. 1 but shows the opposite side;

FIG. 3 corresponds to FIG. 1 but shows the scissors closed;

Figure 6:
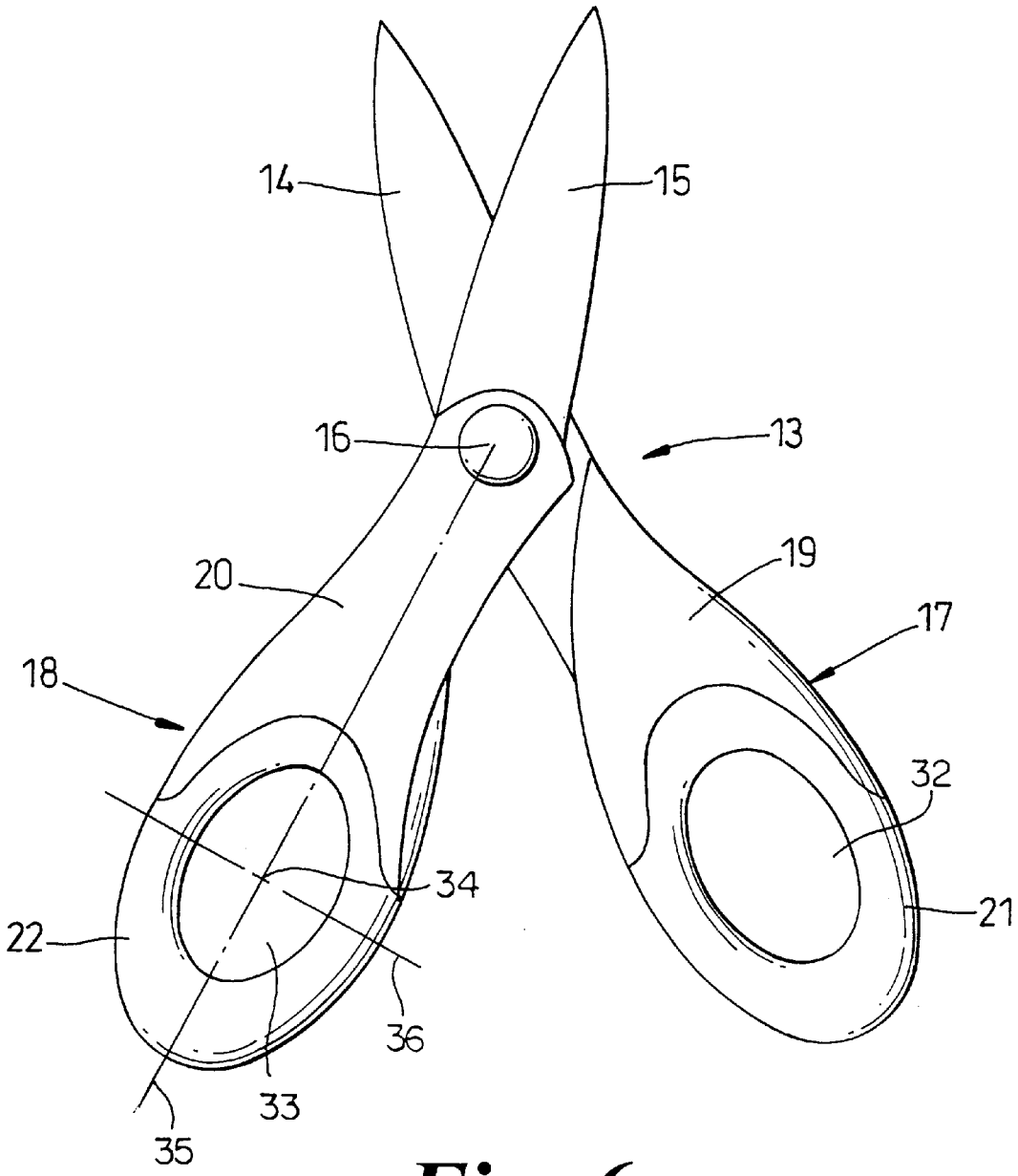
FIG. 6 is an elevation from one side of a small pair of scissors in the open condition.
Figure 7:
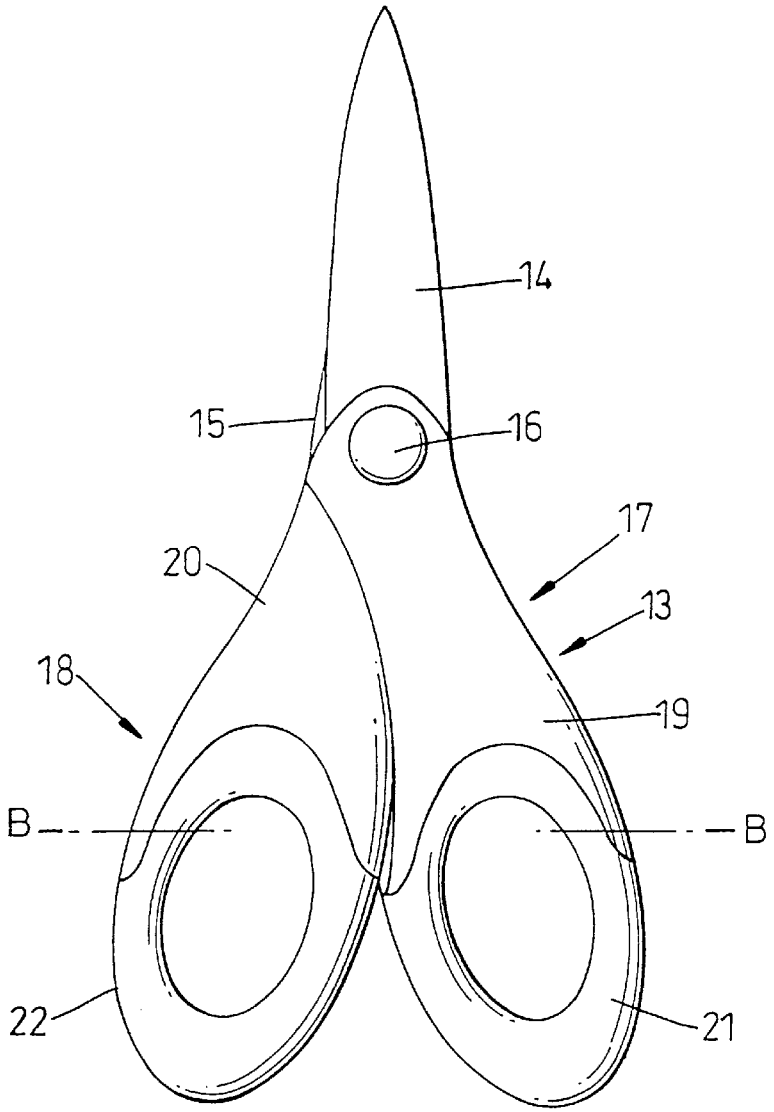
Figure 8:
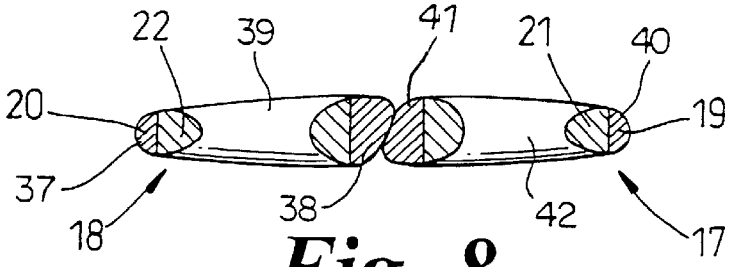

FIG. 7 corresponds to FIG. 6 but shows the scissors closed and from the other side;

FIG. 8 is a section on the line B—B of FIG. 7; and

Figure 9:
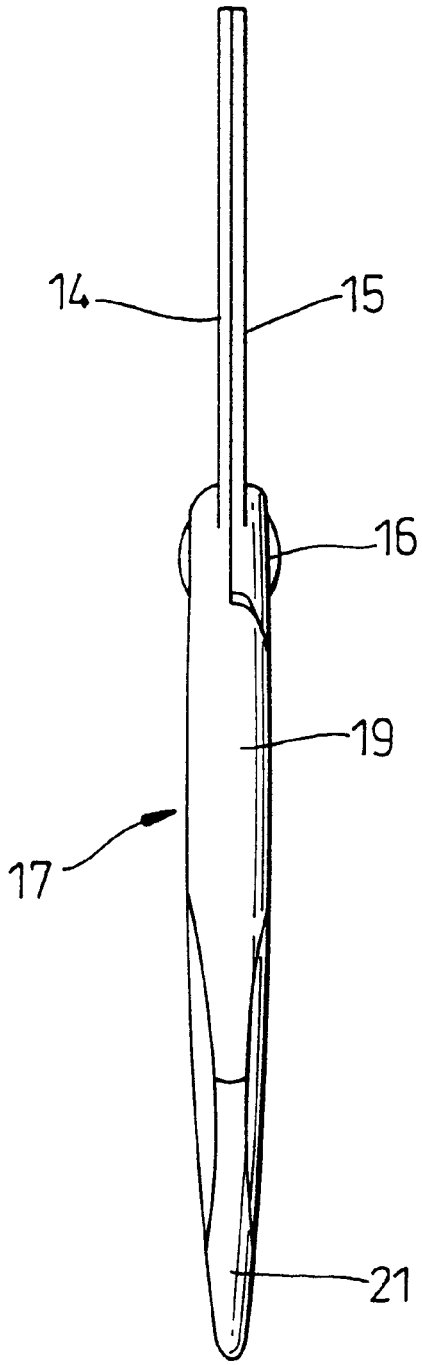

FIG. 9 is a side elevation of the scissors of FIG. 6.

In FIGS. 1 to 5, a large pair of scissors 1 has two blades 2, 3 pivoted together at 4, the blade 2 extending to a thumb bow 5 and the blade 3 extending to a finger bow 6. The thumb and finger bows 5, 6 are of relatively conventional shape, to allow the passage of the thumb through the thumb bow, and several fingers through the finger bow.

Figure 1:
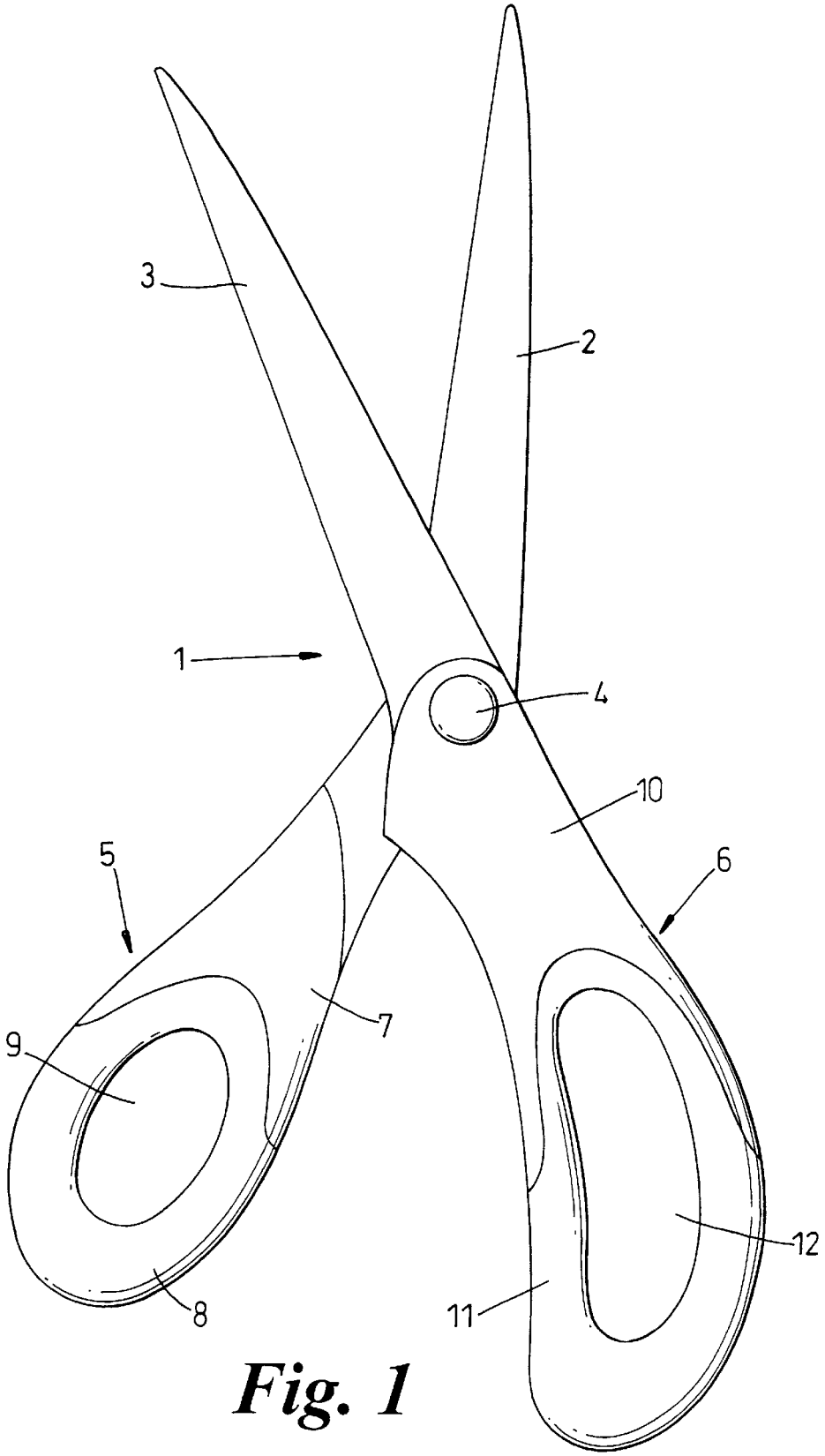
Figure 2:
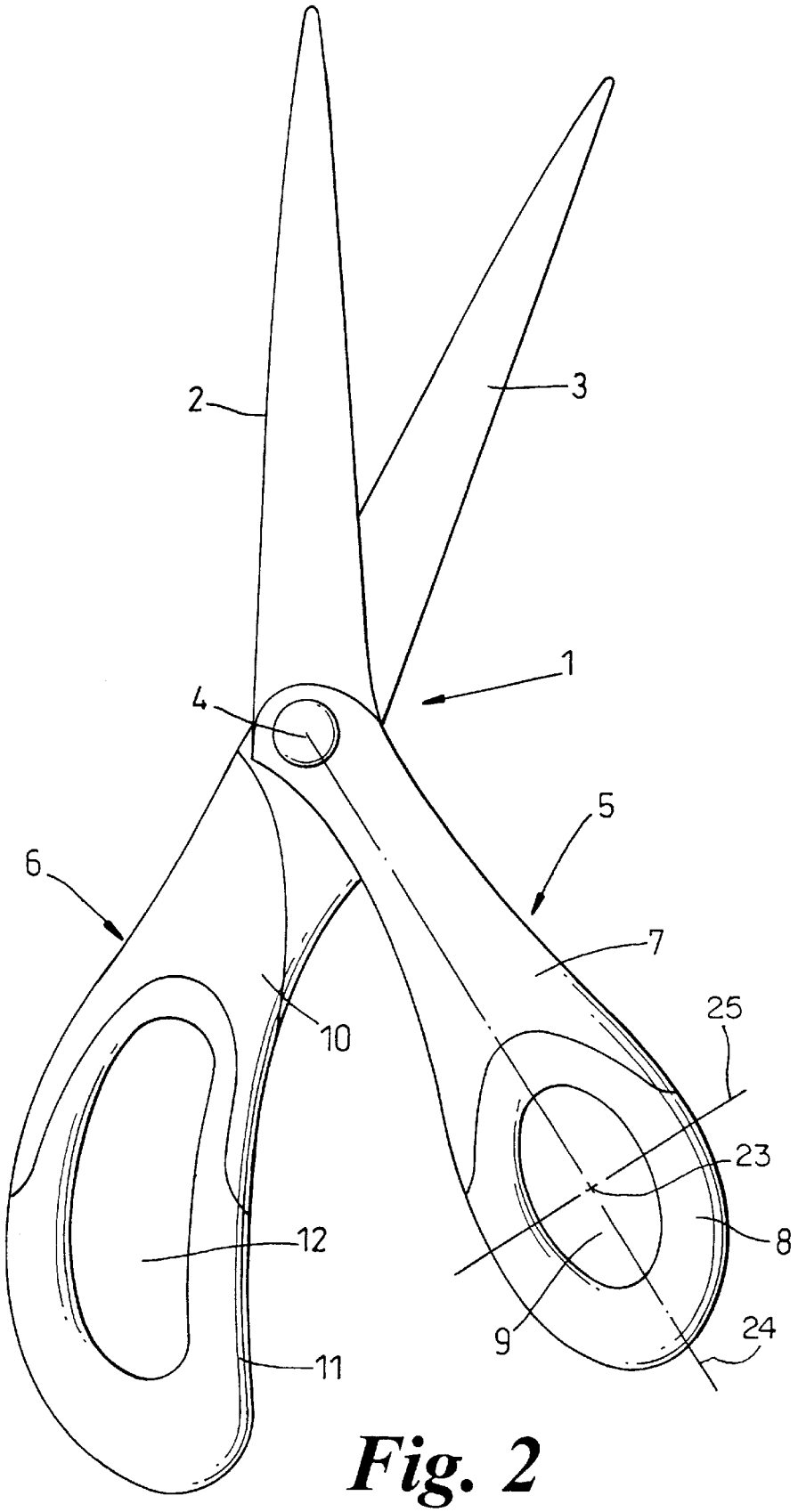
Figure 3:
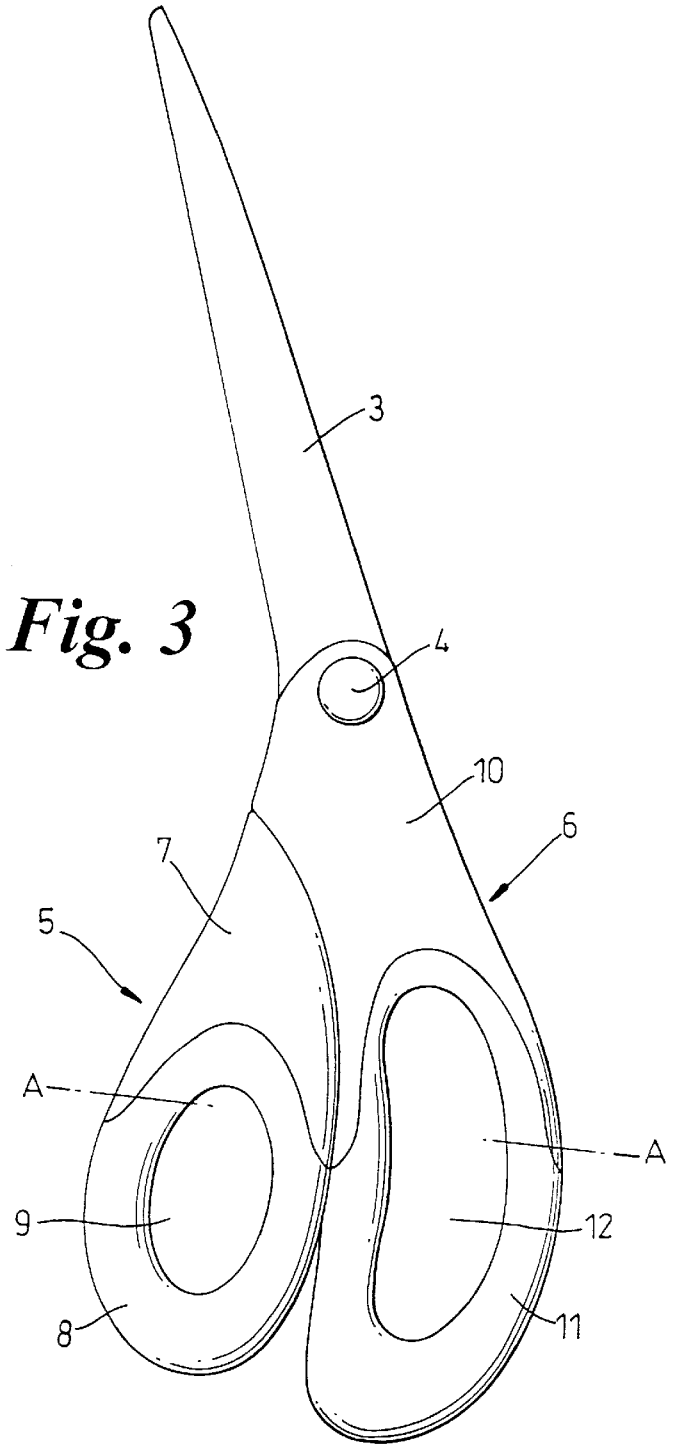
Figure 4:
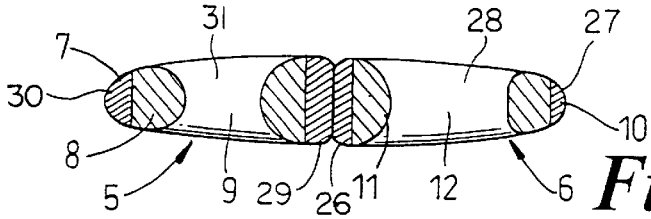
FIG. 4 is a section on the line A—A of FIG. 3.
Figure 5:
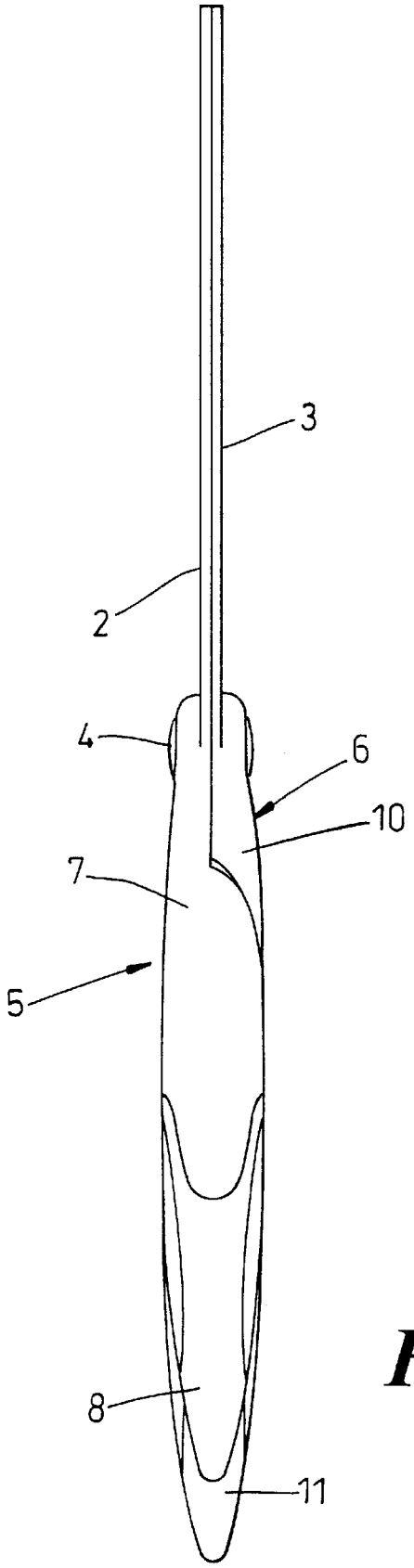
FIG. 5 is a side elevation of the scissors of FIG. 1.

As is shown particularly by FIGS. 4 and 5, the scissors 1, and particularly the thumb and finger bows 5, 6 are symmetrical about the centre plane at the mid-point though their thickness.

The thumb bow 5 has a forward end 7 towards the pivot 4 formed from a rigid material, that may be a metal or an appropriate plastics material such as polypropylene, and from a point part way along the thumb bow 5, there extends a rearward part 8 formed from an appropriate form stable but resilient and/or flexible plastics material such as santoprene. As shown, the aperture or passageway 9 for the thumb through the thumb bow 5 is formed wholly within the rearward part 8 formed from the resilient and/or flexible material. As is clearly shown in FIG. 2, the aperture or passageway 9 of the thumb bow 5 has a centerpoint 23. An axis 24 is defined between the pivot 4 and the centerpoint 23 of the aperture or passageway 9 through the thumb bow 5. A plane 25 is defined through the thumb bow 5 transverse to the axis 24. The forward part 7 of the thumb bow 5 terminates prior to the plane 25 such that the material in the plane 25 is solely formed by the form-stable but flexible material of the rearward part 8. As is clearly shown in FIG. 4, the forward part 7 of the thumb bow 5 includes two spaced portions 29, 30, and the rearward part of the thumb bow 5 has a front portion 31 which is located between and engages the two spaced portions 29, 30 of the forward part 7 of the thumb bow 5. The aperture or passageway 9 of the thumb bow 5 is formed within the rearward part 8 of the thumb bow 5 and at least partially located between the spaced portions 29, 30 of the forward part 7 of the thumb bow 5.

The finger bow 6 may be formed wholly from an appropriate rigid material that may be metal or plastics. However, the finger bow 6 may also be formed with a forward part 10 towards the pivot 4 of rigid material or plastics material such as polypropylene, and a rearward part 11 of a form stable resilient and/or flexible plastics material such as santoprene, with the aperture 12 for the fingers formed wholly within the rearward part 11. As is clearly shown in FIG. 4, the forward part 10 of the finger bow 6 includes two spaced portions 26, 27, and the rearward part 11 of the finger bow 6 has a front portion 28 which is located between and engages the two spaced portions 26, 27 of the forward part 10 of the finger bow 6. The aperture 12 of the finger bow 6 is formed within the rearward part 11 of the finger bow 6 and at least partially located between the spaced portions 26, 27 of the forward part 10 of the finger bow 6.

The forward and rearward parts of the thumb and finger bows may be separately formed and suitably secured together by adhesive or fusion, or they may be co-moulded together.

By having the handles formed symmetrical about their mid plane, the scissors are equally suited to use in either the left or the right hand. With the thumb and fingers of either hand located in the finger 6 and thumb bows 5 and with a cutting force applied to close the blades, pressure by the thumb to one side or the other of the rearward part 8 of the thumb bow, causes it to flex and bend about its connection to the forward part 7, and as a consequence render the scissors suitable for use in comfort by either right handed or left handed users.

In FIGS. 6 to 10, a small pair of scissors 13 is formed by blades 14, 15 pivoted together at 16, the blades extending to identical finger/thumb bows 17, 18 of relatively conventional shape, to allow the passage of the thumb and fingers through the bows.

As is shown particularly by FIGS. 9 and 10, the finger and thumb bows 17, 18 are symmetrical about the centre plane at the mid-point through their thickness.

Both bows 17, 18 are formed by respective forward parts 19, 20 towards the pivot, of a rigid metal or appropriate plastics material such as polypropylene, and from a point along their length with rearward parts 21, 22 of a form stable resilient and/or flexible material such as santoprene, and the apertures 32, 33 in both bows 17, 18 are formed wholly within the rearward parts 21, 22. As is clearly shown in FIG. 6, the aperture 33 of the thumb bow 18 has a centerpoint 34. An axis 35 is defined between the pivot 16 and the centerpoint 34 of the aperture 33 through the thumb bow 18. A plane 36 is defined through the thumb bow 18 transverse to the axis 35. The forward part 20 of the thumb bow 18 terminates prior to the plane 36 such that the material in the plane 36 is solely formed by the form-stable but flexible material of the rearward part 22. As is clearly shown in FIG. 8, the forward part 20 of the thumb bow 18 includes two spaced portions 37, 38, and the rearward part of the thumb bow 18 has a front portion 39 which is located between and engages the two spaced portions 37, 38 of the forward part 20 of the thumb bow 18. The aperture 33 of the thumb bow 18 is formed within the rearward part 22 of the thumb bow 18 and at least partially located between the spaced portions 37, 38 of the forward part 20 of the thumb bow 18. As is clearly shown in FIG. 8, the forward part 19 of the finger bow 17 includes two spaced portions 40, 41, and the rearward part 21 of the finger bow 17 has a front portion 42 which is located between and engages the two spaced portions 40, 41 of the forward part 19 of the finger bow 17. The aperture 32 of the finger bow 17 is formed within the rearward part 21 of the finger bow 17 and at least partially located between the spaced portions 40, 41 of the forward part 19 of the finger bow 17.

The forward and rearward parts of both bows may be separately formed and suitably secured together by adhesive or fusion, or may be co-moulded together.

By having both handles identically formed, and by having them formed symmetrical about their mid plane, the scissors are equally suited to use in either the left or right hand, and either way up.

With the thumb of either hand inserted through one or the other bow, and with a finger inserted through the other bow, and a cutting force applied to close the blades, pressure by the thumb to a respective side of the bow through which the thumb is inserted, causes it to flex and bend about its connection to the respective forward part of the handle, and as a consequence render the scissors suitable for use in comfort by either right or left handed users.

What is claimed is:

1. A pair of scissors comprising: blades and associated handles pivotally secured together, the handles forming respective finger and thumb bows that are symmetrical about the center plane at the mid-point through their thickness, said thumb bow and said finger bow being connected together at a pivot, said thumb bow having an aperture therethrough, said aperture having a centerpoint, and said finger bow having an aperture therethrough, said thumb bow having a forward part proximate to said pivot and a rearward part distal from said pivot, said thumb bow having an axis which is defined between said pivot and said centerpoint of said aperture through said thumb bow, said forward part of said thumb bow being formed as a rigid structure, said rearward part of said thumb bow being formed from a form-stable but flexible material, a plane defined through said thumb bow which is transverse to said axis, said forward part of said thumb bow terminating prior to said plane such that the material in said plane is solely formed by said form-stable but flexible material of said rearward part.

2. A pair of scissors as in claim 1, wherein said aperture through said thumb bow is formed wholly within said rearward part of said thumb bow.

3. A pair of scissors as in claim 1 or claim 2, wherein said finger bow is formed from hard material.

4. A pair of scissors as in claim 1 or claim 2, wherein said finger bow is formed partly from hard material and partly from form-stable but flexible material.

5. A pair of scissors as in claim 4, wherein said aperture in said finger bow is formed wholly within the part of that bow formed from flexible material.

6. A pair of scissors according to claim 4, wherein said finger bow includes a forward part proximate to said pivot and a rearward part distal from said pivot, said forward part of said finger bow includes two spaced portions, and said rearward part of said finger bow has a front portion which is located between and engages said two spaced portions of said forward part of said finger bow.

7. A pair of scissors according to claim 6, wherein said aperture of said finger bow is formed within said rearward part of said finger bow and at least partially located between said spaced portions of said forward part of said finger bow.

8. A pair of scissors as in claim 1, wherein the two bows are identically formed.

9. A pair of scissors as in claim 1, wherein the finger bow is formed larger than the thumb bow.

10. A pair of scissors according to claim 1, wherein said forward part of said thumb bow includes two spaced portions, and said rearward part of said thumb bow has a front portion which is located between and engages said two spaced portions of said forward part of said thumb bow.

11. A pair of scissors according to claim 10, wherein said aperture of said thumb bow is formed within said rearward part of said thumb bow and at least partially located between said spaced portions of said forward part of said thumb bow.

* * * * *